United States Patent [19]

Hatsell

[11] 4,203,676

[45] May 20, 1980

[54] RIBBON MOUNTING APPARATUS

[75] Inventor: William A. Hatsell, Hatfield, Pa.

[73] Assignee: Exxon Research & Engineering Co., Florham Park, N.J.

[21] Appl. No.: 833,352

[22] Filed: Sep. 14, 1977

[51] Int. Cl.[2] ..... B41J 33/14

[52] U.S. Cl. ..... 400/208; 400/242; 400/248

[58] Field of Search ..... 197/151, 170; 101/336

[56] References Cited

U.S. PATENT DOCUMENTS

| | | | |
|---|---|---|---|
| 2,672,092 | 3/1954 | Beattie | 101/336 |
| 3,902,017 | 9/1975 | Frechette | 197/151 |
| 4,047,607 | 9/1977 | Willcox | 197/170 X |
| 4,047,608 | 9/1977 | Willcox | 197/170 X |
| 4,053,043 | 10/1977 | Deetz | 197/151 X |
| 4,074,799 | 2/1978 | Hishida et al. | 197/151 |

FOREIGN PATENT DOCUMENTS

| | | | |
|---|---|---|---|
| 2244603 | 4/1973 | Fed. Rep. of Germany | 197/151 |

*Primary Examiner*—Ernest T. Wright, Jr.
*Attorney, Agent, or Firm*—Norman L. Norris

[57] ABSTRACT

Disclosed is a ribbon cartridge for an impact printer, the cartridge having a housing in which a print ribbon is stored. A segment of the print ribbon is situated outside of the housing and is positioned adjacent the print point by means of a rigid bridge means which spans the print point and which is mounted to bridge piers located on the print element carriage. The bridge means greatly facilitates the mounting of the ribbon cartridge.

19 Claims, 7 Drawing Figures

RIBBON MOUNTING APPARATUS

BACKGROUND OF THE INVENTION

This invention relates in general to impact printers and, more particularly, it relates to impact printers wherein a ribbon moves between a ribbon storage area and a print point to continuously supply fresh ribbon to a position between a character element and a print receiving medium.

In some printers of this type including typewriters, the ribbon storage has been provided by a cartridge. These cartridges are removable so as to permit the ribbon supply to be replenished by merely replacing the ribbon cartridge. Prior art ribbon cartridges typically comprise a supply reel and a take-up reel situated within a housing. Ribbon from the supply reel emerges from the housing and is positioned at the print point. The print point is situated between a character element and the print receiving medium. From the print point, the ribbon returns to the housing where it is stored on a take-up reel.

However, in some prior art impact printers, when the operator desired to change the ribbon cartridge, it was necessary to thread the ribbon around guides which keep the ribbon in the vicinity of the print point and also to thread it through lifters which raise and lower the ribbon each time a character is printed. This threading of the ribbon is time consuming for the operator of the printer and it also presents some risk that the print receiving medium may be in some way defaced by removing and replacing the cartridge, e.g., smearing is not at all uncommon in such circumstances. Further, where the printing medium or ink is of the correctable or lift-off type, the ink may be easily disturbed when the ribbon is threaded so as to impair the printing operation.

Further, in various printers including typewriters such as those manufactured by IBM and SCM, the platen which supports the print receiving medium in the impact printing position remains stationary and the character printing elements move along the platen to the various printing locations. In these printers the ribbon cartridge has been mounted for movement with the character elements and the print point so as to continuously supply fresh ribbon to the print point as the character elements advance. Typically, the cartridge has been supported on a carriage which moves linearly along the platen. The character elements may be transported on the carriage or may be mounted on a ball or wheel oftentimes referred to as a daisy. In some of these type printers, it has been necessary for the operator to remove the ball or daisy when the ribbon cartridge was changed. The removal of the daisy thus increased the time required for the operator to change the cartridge. Further, even if the character element is not removed, it is still necessary to thread the ribbon around the guides and lifters near the print point.

To a certain extent in printers having moving print points the problem of positioning the ribbon has been solved by means of a rigid member connected to the cartridge. The member grasps the ribbon and aligns it near the print point. However, in copending applications Ser. No. 833,270, filed Sept. 14, 1977 in the name of Dan W. Matthias, and Ser. No. 833,257, filed Sept. 14, 1977 in the name of Dan W. Matthias and Collier M. Miller, assigned to the assignee of this invention, it is disclosed that it may be desirable to support the ribbon cartridge in a stationary position and to supply ribbon to a print point movable with respect to the cartridge by means of two flexible leaders which provide a ribbon path of fixed length from the cartridge to the print point and back again to the cartridge. With this type of cartridge, it is necessary to thread the ribbon emanating from the leaders around the guides and lifters near the print point and when the print point is movable with respect to the cartridge, it is not possible to guide the ribbon with a rigid member affixed to the cartridge.

SUMMARY OF THE INVENTION

It is an object of this invention to provide a ribbon cartridge which may be easily inserted by a machine operator without the need for threading.

It is a further object of this invention to provide a ribbon cartridge which may be inserted without physical contact between the operator and the ribbon.

It is still a further object of this invention to provide a ribbon cartridge which may be inserted in an impact printer without removal of the printer's character elements.

It is still a further object of this invention to provide a ribbon cartridge which supplies ribbon to the print point by means of flexible leaders and which still accomplishes the aforementioned objectives.

These and other objects of the present invention are accomplished by means of a ribbon cartridge having a housing for storing ribbon, a segment of said ribbon being situated outside of said housing. This segment passes over a rigid bridge means, the bridge means being movable with respect to the housing and adapted to span across the printer's print point. In one embodiment the bridge means is adapted to be placed on bridge piers which are situated on a movable carriage which thus accurately position the bridge relative to the print point. Further, in the preferred embodiment the ribbon crosses the bridge means on spacers which provide a gap between the ribbon and the bridge while the bridge is being mounted to the bridge piers. The printer's character element is positioned within this gap.

The present invention will be better understood by reference to the accompanying drawing in which.

DETAILED DESCRIPTION OF A PREFERRED EMBODIMENT

Figure 1:
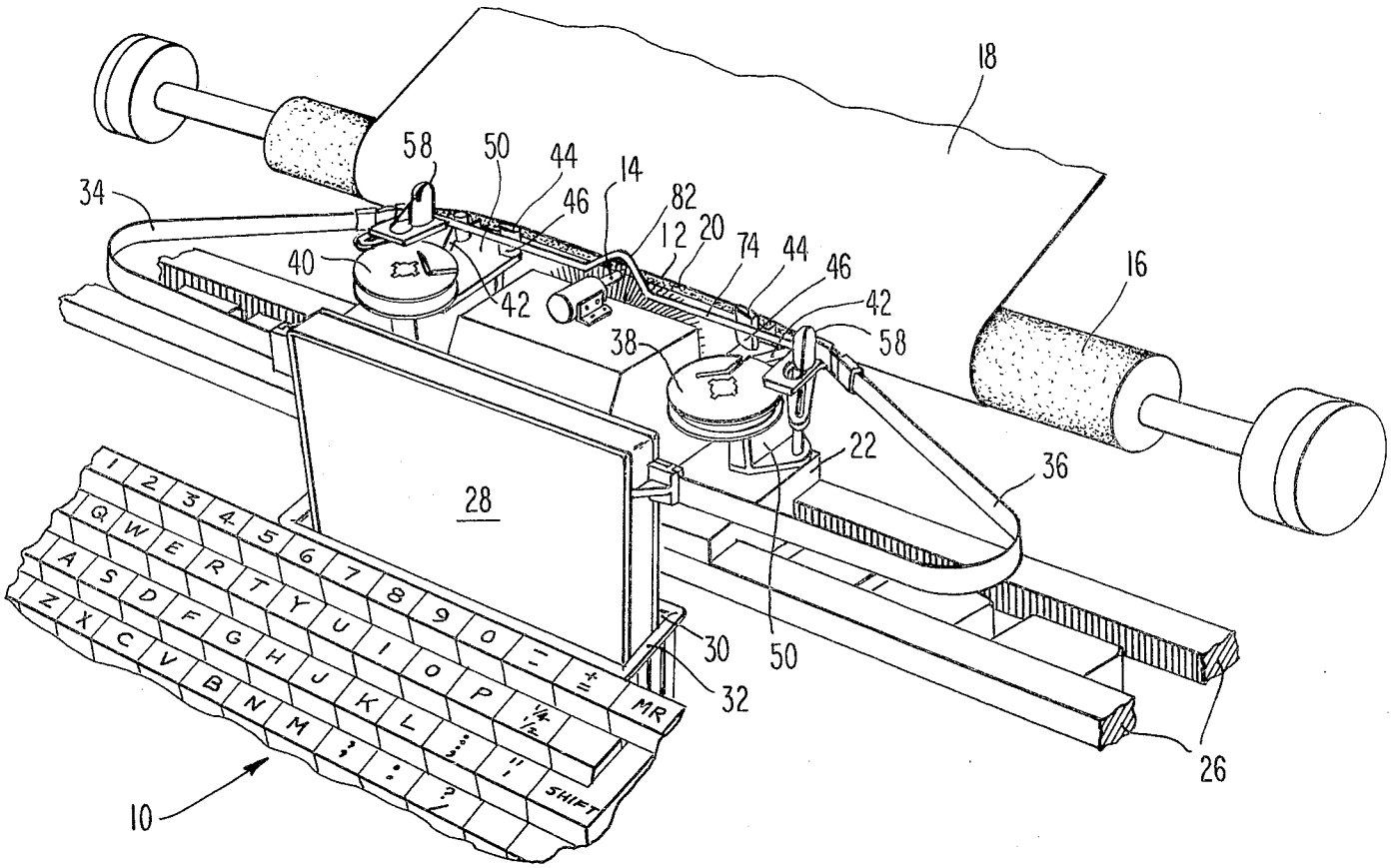
FIG. 1 is a perspective view of printer incorporating the present invention.
Figure 2:
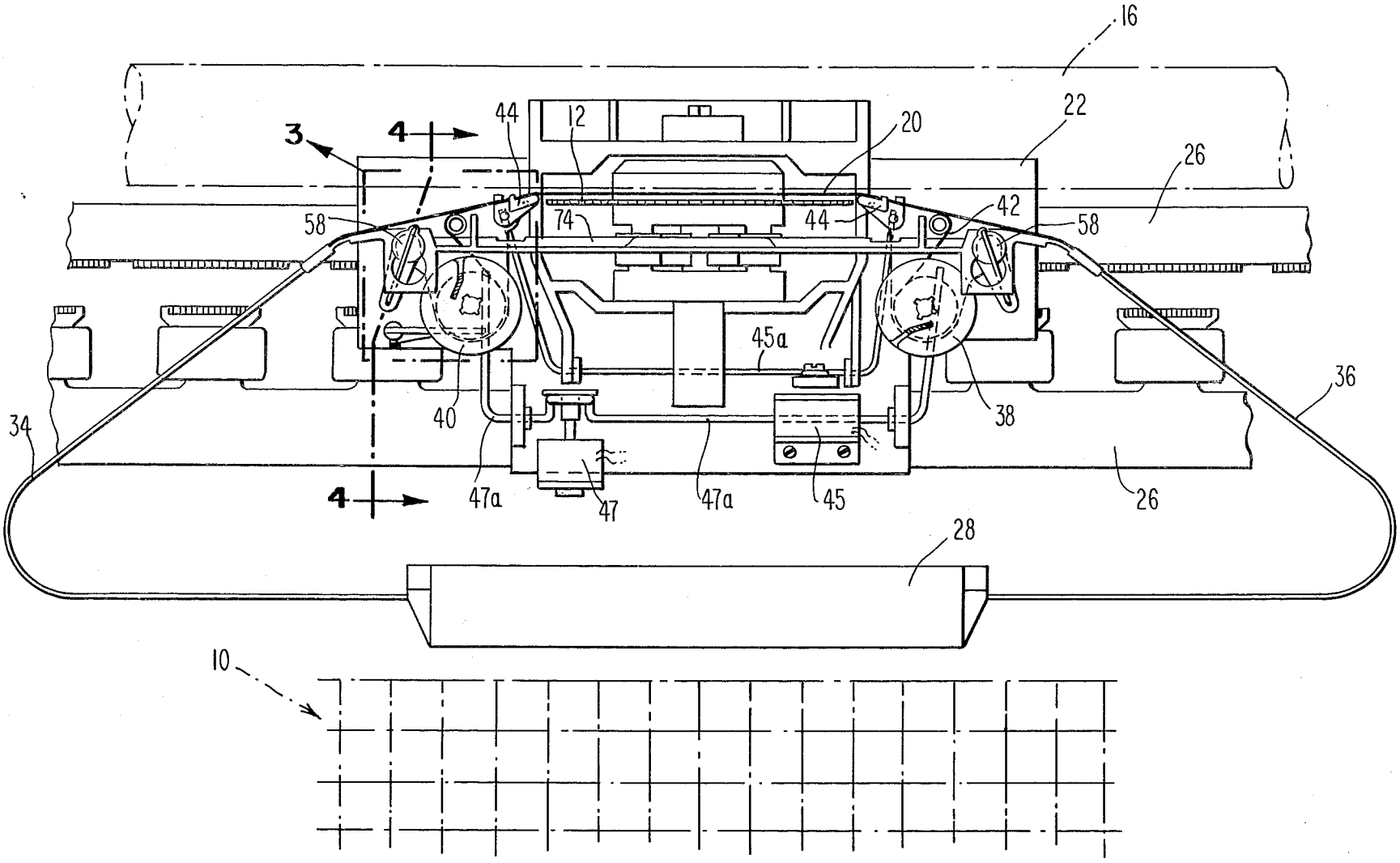
FIG. 2 is a top view of the printer shown in FIG. 1.

A printer comprising a typewriter shown in FIGS. 1 and 2 includes a keyboard 10 having a multiplicity of keys corresponding to various characters which, upon depression, control the position of a rotatable character array in the form of a print wheel or daisy 12 juxtaposed between impact means in the form of a hammer 14 and a platen 16. The platen 16 is adapted to support a print receiving medium in the form of paper 18 which is contacted by the marking medium in the form of a print ribbon 20 which is located between the print wheel 12 and the paper 18 so as to leave a mark in ink corresponding to the particular character of the print wheel 12 which is in position between the hammer 14 and the paper 18.

As shown in FIG. 1, the print wheel 12 and the hammer 14 are mounted on a carriage 22 which is adapted to move in a lateral direction parallel with the surface of the platen 16 so as to position the print wheel 12 at various positions along the paper 18 in response to the depression of keys on the keyboard 10. As the carriage 22 is moved, the print wheel 12 rotates so as to position the proper character element at the end of a radially extending spoke in a printing position aligned with the print hammer 14. The lateral movement of the carriage 22 along the support surfaces 26 may be achieved by various means known in the art including a linear stepper motor.

In accordance with aforesaid copending application Ser. No. 833,270, filed Sept. 14, 1977, assigned to the assignee of this invention, the print ribbon 20 is stored within a housing of a stationary cartridge 28 which is received, by a pocket 30 in an integrally molded receptacle 32. As shown in FIG. 1, the ribbon path length between the print point as determined by the position of the carriage 22 and the cartridge 28 is maintained constant over a substantial portion thereof by a first flexible leader 34 which extends from the cartridge 28 to the carriage 22 and a second flexible leader 36 which extends from the carriage 22 to the cartridge 28.

Between the first flexible leader 34 and the second flexible leader 36 a segment of the ribbon 20 is exposed and this segment is to be positioned adjacent the print point.

As more clearly pointed out in copending application Ser. No. 833,269, filed Sept. 14, 1977, in the names of Collier M. Miller and Michael J. Rello assigned to the assignee of this invention, situated within the cartridge 28 is a supply reel and a take-up reel (not shown) upon which the print ribbon 20 is wound. Further, a dirve means (not shown) is associated with the supply reel and the take-up reel so as to continuously supply a fresh segment of ribbon 20 to the print point.

In addition to the hammer 14, the carriage 22 also supports and transports an erase ribbon supply reel 38 and an erase ribbon take-up reel 40. Wound around the erase ribbon supply reel 38 and positioned adjacent but below the moving print point is an erase ribbon 42 which may be used to remove characters which have been formed on the paper 18 by the print ribbon 20.

Also supported on and transported by the carriage 22 is a mechanism for lifting the print ribbon 20 and the erase ribbon 42 from their rest positions below the print point to their operating positions at the print point. The ribbons 20 and 42 are raised and lowered in order that the operator of the printer is able to observe each printed character after it has been formed on the print receiving medium 18. The print ribbon 20 is elevated to its operating position only when a key of keyboard 10 is depressed. However, the erase ribbon 42 is elevated to its operating position only when the printer is operating in an erase mode. At all other times, the print ribbon 20 and the erase ribbon 42 are maintained in their rest positions below the print point. The particular lifting mechanisms for both of these ribbons 20 and 42 are the subject of my copending application Ser. No. 833,279, filed Sept. 14, 1977, assigned to the assignee of this invention. However, portions of the lifting mechanism will be described here for the sake of clarity.

Figure 3:
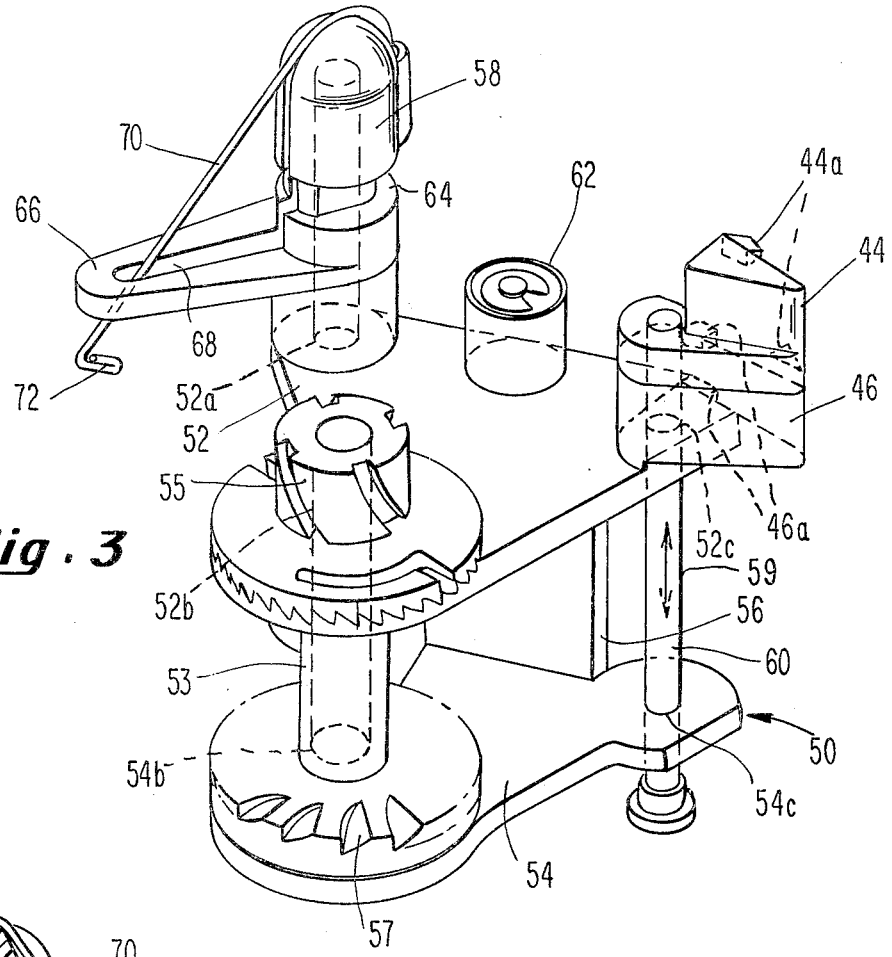
FIG. 3 is a perspective view of one of two ribbon mounting and lifting units which has been shown generally outlined by a dotted portion 3 of FIG. 2.

The print ribbon 20 is elevated to its operating position by means of a pair of ink ribbon lifters 44 which may best be seen from FIG. 3. The erase ribbon 42 is elevated to its operating position by means of a pair of erase ribbon lifters 46. The print ribbons lifters 44 are situated directly above the erase ribbon lifters 46. Lifters 44 and 46 each contain notches **44*a* and 46*a* respectively which cradle the ribbons 20 and 42**.

Figure 4:
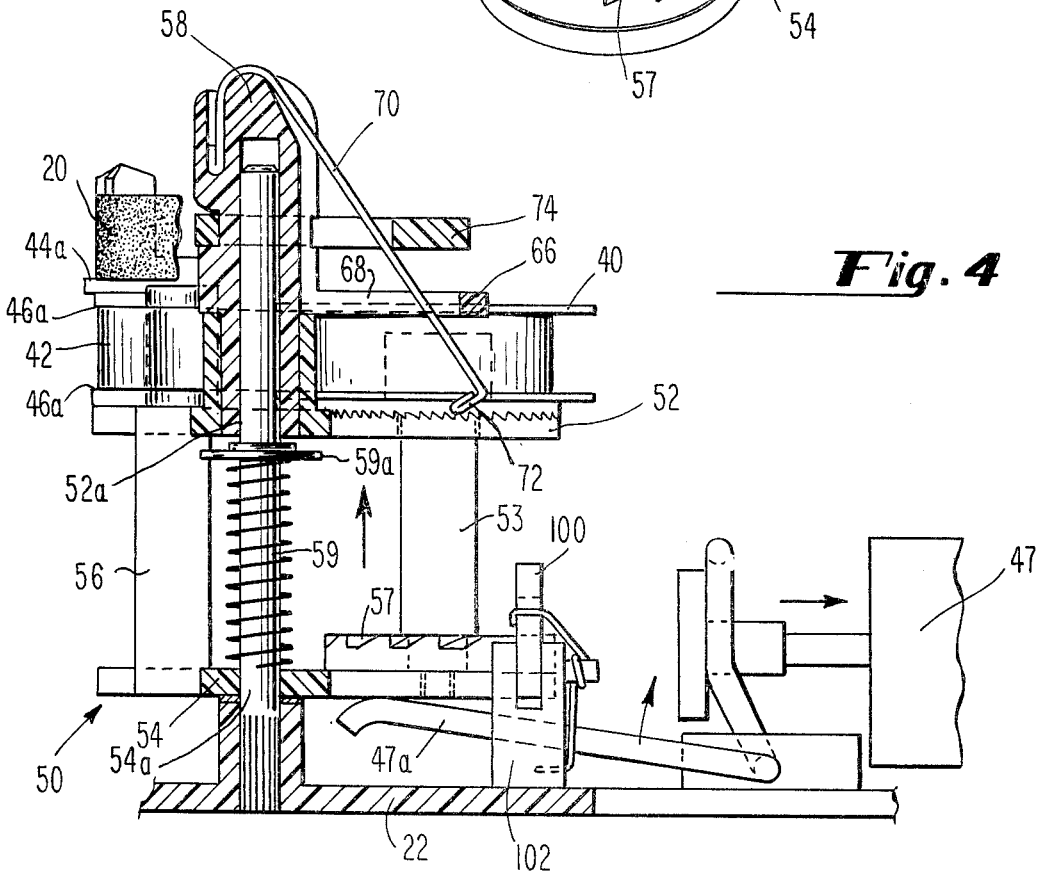
FIG. 4 is a partial sectional view taken along line 4—4 of FIG. 2.

The lifters 44 and 46 are elevated by means of a print ribbon lift magnet 45 and its associated linkage **45*a* and an erase ribbon lift solenoid 47 and its associated linkage 47*a* respectively as shown in FIGS. 2 and 4**.

The lifters 44 and 46 are supported on raisable brackets, one of which is shown generally at 50, which may best be seen in perspective in FIG. 3 and in cross-section in FIG. 4. In the preferred embodiment, the brackets 50 comprise a first planar surface 52 and a second planar surface 54 which are substantially parallel to one another and spaced apart by means of a support 56. Both of the planar surfaces 52 and 54 are pierced by a plurality of apertures **52*a*, 52*b*, and 52*c* and 54*a*, 54*b* and 54*c*** respectively.

Covering the aperture **52*a* on the upper surface of planar surface 52 is an upwardly extending pier 58 which is integral with the bracket 50. The pier 58 contains a bore therein which is aligned with aperture 52*a* and which is slideably mounted over a stationary pin 59 (FIG. 4) which is attached to and transported by the carriage 22 and which also passes through the aperture 54*a* of the second planar surface 54. Fixed to the pin 59 is a flange 59*a***.

In the preferred embodiment, the pier 58 is formed to a generally cylindrical shape having a first outside diameter. However, as shown in FIG. 3, the pier 58 has a region of generally reduced diameter 64 below which is an outwardly extending flange 66. The flange 66 contains a slot 68 therein. A spring means 70 fastened to the top of the pier 58, as shown, extends through the slot 68 and is fabricated such that at the slot 68, it is biased away from the pier 58. Further, in the preferred embodiment, the spring means 70 includes a foot 72. Passing through apertures **52*b* and 54*b* is a spindle 53 having a top portion 55 around which the erase ribbon supply reel 38 and the erase ribbon take-up reel 40 rotate. On the side of the printer on which the erase ribbon take-up reel 40 is found, the bottom portion 57 of the spindle 53 is ratcheted such that a pawl 100 mating with the ratchet of the spindle 53 will impart rotational movement to the take-up reel 40 to advance the erase ribbon 42. Passing through apertures 52*c* and 54*c* is a shaft 60. The shaft 60 passes through and is unattached to the erase ribbon lifters 46; however, the shaft 60 is fixedly mounted to the print ribbon lifter 44, such that a movement of the shaft 60 will be imparted to the print ribbon lifter 44 but not to the erase ribbon lifter 46. Activation of the print ribbon magnet 45 causes its associated linkage 45*a* to elevate the shaft 60 and, thus, the print ribbon lifter 44 to the print point. Activation of the erase ribbon solenoid 47 and its associated linkage 47*a* cause each of the brackets 50 to slide along the stationary pins 59 and thus be elevated into the erase ribbon operating position. As may be appreciated from FIG. 4, when the bracket 50 is elevated, both the print ribbon lifter 44 and the erase ribbon lifter 46 as well as the erase ribbon supply and take-up reels 38 and 40** respectively are elevated.

Further, each of the planar surfaces 52 is provided with an erase ribbon guide member 62 which maintains the erase ribbon 42 in tension as it proceeds from the erase ribbon supply reel 38 to the erase ribbon take-up reel 40.

Figure 5:
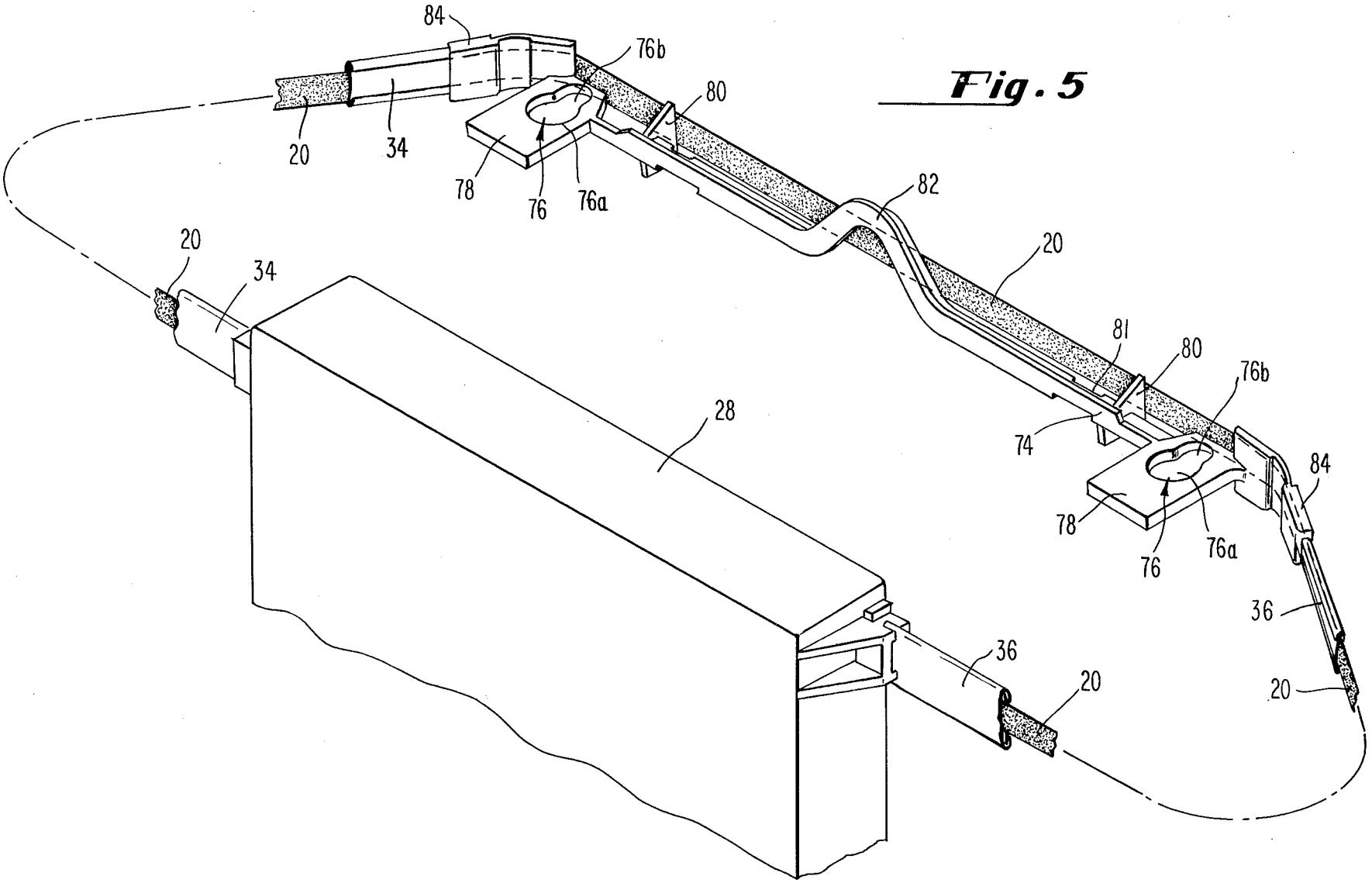
FIG. 5 is a perspective view of one embodiment of a ribbon bridge in accordance with the present invention.

Referring now to FIG. 5 and in accordance with the present invention, a means is provided for quickly and accurately locating the segment of the print ribbon 20 which is situated outside of the cartridge 28 and intermediate the ends of the flexible leaders 34 and 36 adjacent the print point. The means comprises a rigid bridge means 74, which is rigid relative to the leaders 34 and 36, and which spans across the print point. The bridge means 74 is adapted to be mounted upon the piers 58.

In the preferred embodiment the bridge means 74 is provided at each end thereof with apertures 76 each of which has a large diameter portion **76*a* and a small diameter portion 76*b* as shown. The large diameter portion 76*a* has a dimension slightly larger than the outside dimension of the piers 58 while the small diameter portion 76*b* is slightly larger than the region of reduced diameter 64 of the pier 58**.

Further, the bridge means 74 is provided with finger grips 78 for grasping the bridge means 74 and thus positioning it adjacent the print point. These finger grips 78 preferably are located in the vicinity of the apertures 76 as shown.

In the preferred embodiment, the bridge means 74 is fastened to the flexible leaders 34 and 36 by means of integral clips 84 which abut and surround the leaders 34 and 36.

The print ribbon 20 passes over a lateral face of the bridge means 74 on its way from the supply reel to the take-up reel, and, in the preferred embodiment spacers 80 maintain a gap 81 between the ribbon 20 and the main portion of the bridge means 74. In this way, while the bridge means 74 is being mounted the radially extending spokes of the print wheel 12 may be positioned between the bridge means 74 and the print ribbon 20. In the preferred embodiment the bridge means 74 is provided with an arch 82 through which the hammer 14 travels on its way toward impact with the print wheel 12.

Figure 6:
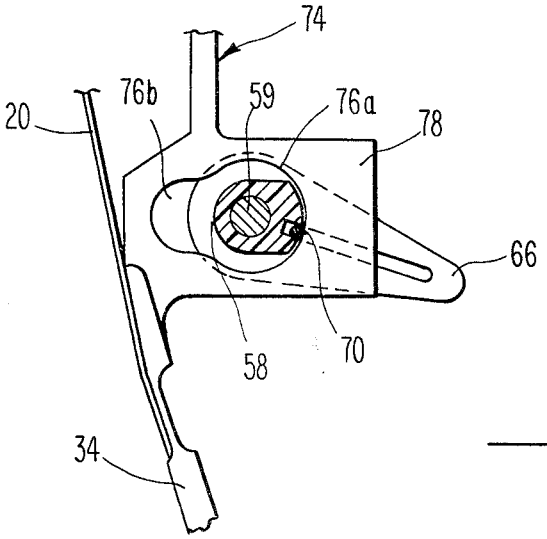
FIG. 6 is a sectional view of a portion of a ribbon bridge which is being mounted in accordance with the teachings of the present invention taken along line 6—6 of FIG. 7.

The mounting of the ribbon cartridge 28 on the printer shown in FIG. 1 is greatly simplified by means of the bridge means 74. After the cartridge 28 has been placed in the pocket 30 of the receptacle 32, the flexible leaders 34 and 36 which are joined by the bridge means 74 are positioned near the print point. At this time, before the bridge means 74 is mounted to the piers 58, the spring means 70 which is attached to the piers 58 is in the condition shown in FIG. 3, i.e., each of the spring means 70 are biased as much as possible away from the piers 58. The print wheel 12 is then positioned within the gap 81 and the large diameter portions **76*a* of the apertures 76 are positioned over each of the piers 58, thus compressing each of the spring means 70 toward the piers 58 as shown in FIG. 6**.

The bridge means 74 is then lowered until the print ribbon 20 has reached its rest position at which the small diameter portion **76*b* of the aperture 76 mates with the region of reduced diameter 64 of the pier 58. When this condition occurs, the bridge means 74 is biased away from the platen 16 by the action of the springmeans 70 as shown in FIG. 4. With the bridge means 74 in this position, the notches 44*a* of the print ribbon lifters 44 engage the print ribbon 20, and the spacers 80** are separated from it.

Figure 7:
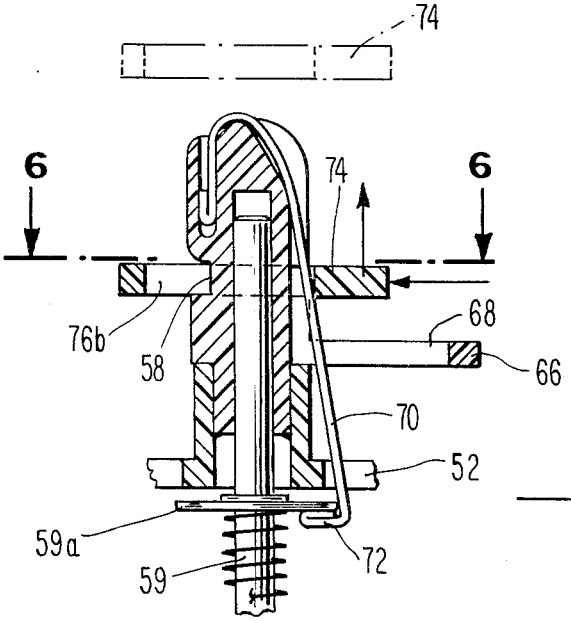
FIG. 7 is a partial cross-sectional view taken along line 4—4 of FIG. 2 during an unmounting of the ribbon bridge of FIG. 5.

In order to remove the ribbon bridge means 74 from the piers 58, the operator merely pushes the bridge means 74 toward the platen 16 against the tension of the spring means 70. Simultaneously, the operator lifts the bridge means 74 from the piers 58. This action tends to remove the print ribbon 20 from under the notches **44*a* of the print ribbon lifters 44. However, in the event that the ribbon 20 may not be properly released from the notches 44*a*, the foot 72 of the spring means 70 is adapted to engage the flange 59*a* of the pin 59 (FIG. 7). This prevents the entire bracket 50 from riding up along with the ribbon 20 during the dismount of the cartridge 28 and causes the print ribbon 20 to free itself from the notches 44*a***.

Although a particular embodiment has been shown and described, various modifications may be made which fall within the true spirit and scope of the invention as set forth in the appended claims.

What is claimed is:

1. A removable ribbon storage apparatus for an impact printer of the type having a print point adjacent a print receiving medium and a character element striking said medium at said print point, said apparatus comprising:

a housing for storing ribbon;

a ribbon;

substantially rigid bridge means over which said ribbon passes;

a flexible leader extending between said bridge means and said housing for guiding said ribbon while permitting said bridge means to move relative to said housing; and said ribbon being supported by and remaining in substantially the same position relative to said bridge means during printing and after removal from said impact printer.

2. The apparatus of claim 1, wherein said bridge means is attached to one end of said flexible leader.

3. The apparatus of claim 1 wherein said bridge means further comprises at least one spacer for maintaining a gap between said ribbon and said bridge means at said print point and after removal from said impact printer.

4. The apparatus of claim 1 wherein said bridge means comprises an arch.

5. The apparatus of claim 1 in combination with a printing system comprising:

a carriage movable relative to said housing;

a print element carried on said carriage and juxtaposed to said ribbon at said bridge means; and a hammer means for striking said print element so as to move said print element into contact with said ribbon while supported by said bridge means and mark a print receiving medium with said print element.

6. The apparatus of claim 5 wherein said carriage includes at least two upwardly extending bridge piers upon which said bridge means is positioned, said piers being immediately adjacent said ribbon.

7. The apparatus of claim 6 wherein said bridge means is retained at said bridge piers by spring means.

8. The apparatus of claim 7 wherein said carriage includes a pair of raisable platforms, one on each side of said print point, and wherein said bridge piers extend from said platforms.

9. The apparatus of claim 8, wherein said spring means engage said carriage when said bridge means is removed from said piers whereby said platforms are not elevated.

10. The apparatus of claim 5 wherein said bridge means comprises an arch through which said hammer means reciprocates.

11. A removable ribbon storage apparatus for an impact printer of the type having a print point adjacent a print receiving medium and a character element striking said medium at said print point, said apparatus comprising:

a housing for storing ribbon;

a ribbon;

substantially rigid bridge means for supporting said ribbon and over which said ribbon passes; and a first flexible leader extending between said housing and said bridge means and a second flexible leader extending between said bridge means and said housing while permitting said bridge means to move relative to said housing;

said ribbon remaining in substantially the same plane relative to said bridge means during printing and after removal from said impact printer.

12. The apparatus of claim 11 wherein said bridge means is attached to ends of said first flexible leader and said second flexible leader.

13. The apparatus of claim 11 wherein said bridge means further comprises at least one spacer for maintaining a gap between said ribbon and said bridge means at said print point and after removal from said impact printer.

14. The apparatus of claim 11 wherein said bridge means comprises an arch.

15. The apparatus of claim 11 in combination with a printing system comprising:

a carriage movable relative to said housing;

a print element carried on said carriage and juxtaposed to said ribbon at said bridge means; and a hammer means for striking said print element so as to move said print element into contact with said ribbon while supported by said bridge means and mark a print receiving medium with said print element.

16. The apparatus of claim 15 wherein said carriage includes at least two upwardly extending bridge piers upon which said bridge means is positioned, said piers being immediately adjacent said ribbon.

17. The apparatus of claim 16 wherein said bridge means is retained at said bridge piers by spring means.

18. The apparatus of claim 17 wherein said carriage includes a pair of raisable platforms, one on each side of said print point, and wherein said bridge piers extend from said platforms.

19. The apparatus of claim 18 wherein said spring means engage said carriage when said bridge means is removed from said piers whereby said platforms are not elevated.

* * * * *